US006521387B2

(12) United States Patent
Kawasaki

(10) Patent No.: US 6,521,387 B2
(45) Date of Patent: Feb. 18, 2003

(54) ELECTROPHOTOGRAPHIC PHOTORECEPTOR, METHOD OF MANUFACTURING THE PHOTORECEPTOR, AND ELECTROPHOTOGRAPHIC IMAGE FORMING METHOD AND APPARATUS USING THE PHOTORECEPTOR

(75) Inventor: Yoshiaki Kawasaki, Susono (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/851,128

(22) Filed: May 9, 2001

(65) Prior Publication Data

US 2002/0094487 A1 Jul. 18, 2002

(30) Foreign Application Priority Data

May 9, 2000 (JP) ..... 2000-135978
Apr. 27, 2001 (JP) ..... 2001-132881

(51) Int. Cl.[7] ..... G03G 15/02
(52) U.S. Cl. ..... 430/59.5; 430/58.05; 399/159
(58) Field of Search ..... 430/59.5, 58.05; 399/159

(56) References Cited

U.S. PATENT DOCUMENTS 6,026,262 A * 2/2000 Kinoshita et al. ..... 399/252
2001/0051307 A1 * 12/2001 Ikuno et al. ..... 430/58.05

FOREIGN PATENT DOCUMENTS

| | | |
|---|---|---|
| JP | 57148745 | 9/1982 |
| JP | 59031965 | 2/1984 |
| JP | 59036254 | 2/1984 |
| JP | 59044054 | 3/1984 |
| JP | 61239248 | 10/1986 |
| JP | 62067094 | 3/1987 |
| JP | 63000366 | 1/1988 |
| JP | 63116158 | 5/1988 |
| JP | 01017066 | 1/1989 |
| JP | 03035064 | 2/1991 |
| JP | 03035245 | 2/1991 |
| JP | 03037669 | 2/1991 |
| JP | 03269064 | 11/1991 |
| JP | 07319179 | 12/1995 |

OTHER PUBLICATIONS

Ladd, Structure Determination by X–Ray Crystallography, 1985, p. 426.*

* cited by examiner

*Primary Examiner*—Mark A. Chapman
(74) *Attorney, Agent, or Firm*—Oblon, Spivak, McClelland, Maier & Neustadt, P.C.

(57) ABSTRACT

A photoreceptor including an electroconductive substrate; a charge generation layer formed overlying the electroconductive substrate and including as a charge generation material a titanyl phthalocyanine crystal having an X-ray diffraction spectrum such that a maximum diffraction peak is observed at a Bragg (2θ) angle of 27.2°±0.2° when a specific X-ray of Cu-Kα having wavelength of 1.542 Å irradiates the titanyl phthalocyanine crystal; and a charge transport layer formed on the charge generation layer and including a binder resin, a charge transport material, water and tetrahydrofuran, wherein a weight ratio of the water to the tetrahydrofuran in the charge transport layer is from 1/50 to 1/0.5.

23 Claims, 5 Drawing Sheets

ELECTROPHOTOGRAPHIC PHOTORECEPTOR, METHOD OF MANUFACTURING THE PHOTORECEPTOR, AND ELECTROPHOTOGRAPHIC IMAGE FORMING METHOD AND APPARATUS USING THE PHOTORECEPTOR

BACKGROUND OF THE INVENTION

1. Field of the Invention

The present invention relates to an electrophotographic photoreceptor. In addition, the present invention relates to a method for manufacturing the photoreceptor, and to an electrophotographic image forming method and apparatus using the electrophotographic photoreceptor.

2. Discussion of the Background

Recently the growth of electrophotographic information processing apparatus (hereinafter image forming apparatus) such as copiers, printers and facsimiles is remarkable. In particular, photo-printers capable of recording digital information using light have been drastically improving in recording qualities and reliability. This digital recording technique is applied to copiers as well as photo-printers. The digital copiers to which this digital technique is applied have various image forming functions. Therefore it is considered that the demand for the digital copiers increases more and more.

At the present time, laser diodes (LDs) and light emitting diodes (LEDs) are used as light sources for the photo-printers because of being small in size, and having a relatively low cost and good reliability. The LEDs which are typically used for the photo-printers emit light having a wavelength of 660 nm. The LDs which are typically used for the photo-printers emit near infrared light. Therefore, a need exists for a photoreceptor having high sensitivities over a wavelength range including the visible region and the near infrared region.

The wavelength range over which an electrophotographic photoreceptor has sensitivity almost depends on the wavelength range over which the charge generation material used in the photoreceptor has photosensitivity. Therefore, various kinds of materials, such as azo type pigments, polycyclic quinone type pigments, trigonal system selenium, phthalocyanine pigments and the like, have been developed for the charge generation materials.

Among these pigments, titanyl phthalocyanine pigments (hereinafter sometimes referred to as TiOPcs), which have been disclosed in Japanese Laid-Open Patent Publications Nos. (hereinafter JOPs) 3-35064, 3-35245, 3-37669, 3-269064 and 7-319179, are very useful as a photosensitive material for a photoreceptor used for electrophotographic image forming apparatus such as printers and copiers, which use an LED or LD as a light source. This is because titanyl phthalocyanine is sensitive to light having a relatively long wavelength of from 600 to 800 nm.

A photoreceptor used for electrophotography such as Carlson process and the like processes is required to have the following charge properties as well as the high sensitivity to the specific light mentioned above:

(1) good charging ability such that a high electric potential can be formed and maintained in a dark place;

(2) good charge decaying ability such that the electric potential previously formed on the photoreceptor rapidly decays and the residual potential is low when the photoreceptor is exposed to light; and (3) good charge stability such that the photoreceptor can maintain a good charging ability and a good charge decaying ability even when the photoreceptor is used for a long time.

In particular, in high sensitive photoreceptors such as photoreceptors including a TiOPc, the charging ability tends to deteriorate and the residual potential tends to increase when the photoreceptors are repeatedly used. Namely, the photoreceptors including a TiOPc have an insufficient charge stability. Therefore, a need exists for a photoreceptor including a TiOPc, which has good charge stability.

The methods for synthesizing TiOPcs and the electrophotographic properties of the resultant TiOPc have been disclosed in JOPs Nos. 57-148745, 59-36254, 59-44054, 59-31965, 61-239248, 62-67094 etc. In addition, various crystal forms are known with respect to TiOPcs, and JOPs Nos. 59-49544, 59-166959, 61-239248, 62-67094, 63-366, 63-116158, 63-196067, 64-17066 etc. have disclosed TiOPcs having a different crystal form.

Among these TiOPcs, the TiOPc crystals having an X-ray diffraction spectrum such that a main diffraction peak is observed at a Bragg ($2\theta$) angle of $27.2° \pm 0.2°$ when the crystals are exposed to the Cu-K$\alpha$ X-ray have high photosensitivity particularly in a near infrared region. It is known that this TiOPc crystals have molecules of water therein as disclosed in Abstracts of the third meeting of Electrophotographic Technical Committee in 1991.

The TiOPcs mentioned above change their crystal forms when the water molecules release therefrom, resulting in changes of photosensitivity thereof. In attempting to avoid such changes of photosensitivity, JOP No. 04-338967 discloses a method in which water is included in a TiOPc when the TiOPc is synthesized. In addition, JOP No. 10-115940 discloses a photoreceptor including a charge generation layer including water therein.

On the other hand, halogen-containing solvents such as methylene chloride have been used for charge transport layer coating liquids because of having the following advantages:

(1) the coating liquids have good productivity;

(2) the resultant charge transport layer has good coating qualities;

(3) the resultant photoreceptor has good charging properties; and (4) the solvents has a relatively low cost.

Halogen-containing solvents are not typically compatible with water. Therefore, the resultant photoreceptors tend not to cause such a problem as mentioned above.

However, currently it is considered that halogen-containing solvents adversely affect the natural environment and human being. For example, we must follow the laws concerning environmental protection such as "Pollutant Release and Transfer Register" (PRTR Law) in Japan. Therefore, in order to protect environment, it is needed that halogen-containing solvents are replaced with other solvents including no halogen atom when charge transport layers are formed.

Among solvents including no halogen atom for use in charge transport layer coating liquids, tetrahydrofuran is promising because the resultant photoreceptor has better charge properties than that prepared by coating liquid including a halogen-containing solvent when the charge transport layer coating liquids are coated after preserved for a long period of time. However, tetrahydrofuran is mixed with water at any mixing ratio. Therefore when a coating liquid including tetrahydrofuran is used for forming a charge transport layer, the resultant charge transport layer tends to change the crystal form of the TiOPc included in the charge generation layer which contacts the charge transport layer, resulting in deterioration of the photosensitivity of the photoreceptor.

Because of these reasons, a need exists for a photoreceptor having high sensitivity and good charge stability even when repeatedly used for a long period of time.

SUMMARY OF THE INVENTION

Accordingly, an object of the present invention is to provide a photoreceptor having a good combination of high sensitivity and good charge stability even when the photoreceptor is repeatedly used for a long period of time.

Another object of the present invention is to provide a method for manufacturing the photoreceptor of the present invention.

Yet another object of the present invention is to provide an electrophotographic image forming method and apparatus (including a process cartridge) in which good images can be stably produced without causing undesired images even when images are repeatedly produced for a long period of time.

Briefly these objects and other objects of the present invention as hereinafter will become more readily apparent can be attained by a photoreceptor including an electroconductive substrate and a photosensitive layer which is formed on the substrate and which includes at least a charge generation layer and a charge transport layer including at least a charge transport material, a binder resin, water and tetrahydrofuran (hereinafter referred to as THF), wherein the charge generation layer includes a titanyl phthalocyanine crystal which has an X-ray diffraction spectrum such that a maximum diffraction peak is observed at a Bragg (2θ) angle of 27.20°±0.20° when a specific X-ray of Cu-Kα (wavelength of 1.542 Å) irradiates the titanyl phthalocyanine crystal, and wherein a weight ratio, water/THF, in the charge transport layer is from 1/50 to 1/0.5. The weight ratio is preferably from 1/20 to 1/0.8 and more preferably from 1/10 to 1/1.

The content of THF in the charge transport layer (i.e., a weight ratio of THF to the total solid components of the charge transport layer) is preferably from 0.01 to 0.5% by weight.

The binder resin in the charge transport layer preferably includes a bisphenol-Z-form polycarbonate resin.

In another aspect of the present invention, a method for manufacturing a photoreceptor is provided which includes the steps of forming a charge generation layer including a TiOPc overlying an electroconductive substrate; and coating a coating liquid including a binder resin, a charge transport material, water and THF to form a charge transport layer on the charge generation layer, wherein the TiOPc has an X-ray diffraction spectrum such that a maximum diffraction peak is observed at a Bragg (2θ) angle of 27.2°±0.2° when a specific X-ray of Cu-Kα (wavelength of 1.542 Å) irradiates the titanyl phthalocyanine crystal, and wherein a weight ratio, water/THF, of the water to the THF included in the charge transport layer is from 1/50 to 1/0.5.

The content of the water included in the charge transport layer coating liquid is preferably from 0.1% to 4.0% by weight In yet another aspect of the present invention, an electrophotographic image forming method is provided which includes the steps of charging a photoreceptor, irradiating the photoreceptor with imagewise light to form an electrostatic latent image thereon, developing the latent image with a toner to form a toner image, transferring the toner image to a receiving material, cleaning the photoreceptor after the image transferring, and discharging the residual potential of the photoreceptor after the cleaning, wherein the photoreceptor is the photoreceptor of the present invention mentioned above.

In a further aspect of the present invention, an electrophotographic image forming apparatus is provided which includes the photoreceptor of the present invention mentioned above, an image irradiator, an image developer, an image transfer, a cleaner and a discharger. A process cartridge including at least a housing and the photoreceptor of the present invention is also provided.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like of corresponding parts throughout and wherein.

DESCRIPTION OF THE PREFERRED EMBODIMENTS

The structure of the titanyl phthalocyanine crystal of the present invention is as follows:

(1)

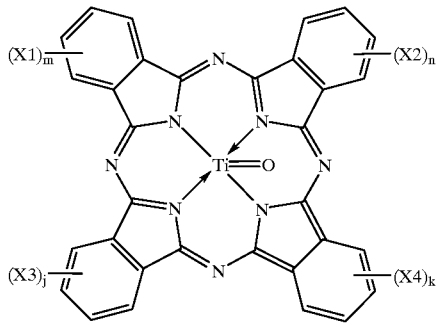

wherein X1, X2, X3 and X4 independently represent a halogen atom, and n, m, j and k are independently 0 or an integer of from 1 to 4.

The TiOPc crystal for use in the photoreceptor of the present invention can be prepared, for example, by the following methods:

(1) the TiOPc crystal is synthesized by a known synthesizing method;

(2) the crystal form of a TiOPc is changed by a crystal changing method in which the crystal form of the TiOPc is changed in washing and/or refining processes; and (3) the crystal form of a TiOPc is changed by another crystal form changing method in which an additional crystal form changing process is performed after a TiOPc is prepared.

As the crystal-form changing method (3), the following methods can be used:

(1) the solvent of a liquid including a TiOPc pigment is changed;

(2) a liquid including a TiOPc pigment is subjected to a mechanical treatment under load conditions; or (3) a sulfuric acid pasting method in which TiOPc having an amorphous crystal form, which is prepared by dissolving titanyl phthalocyanine in sulfuric acid and then adding the solution into water, is subjected to a crystal changing process in which the TiOPc pigment having an amorphous form is contacted with an organic solvent in the presence of water.

The photoreceptor of the present invention will be explained in detail.

Figure 1:
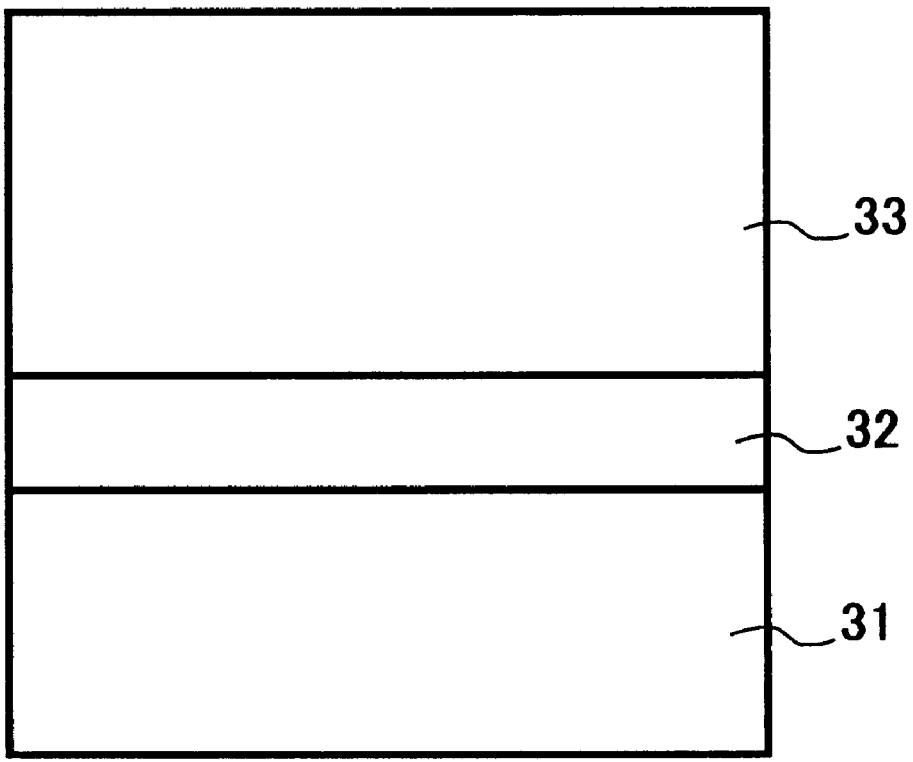
FIG. 1 is a schematic cross-sectional view of an embodiment of the electrophotographic photoreceptor of the present invention.

FIG. 1 illustrates the structure of an embodiment of the photoreceptor of the present invention in which a charge generation layer 32 and a charge transport layer 33 are formed on an electroconductive substrate 31 in this order. In this case, the combination of the charge generation layer 32 and the charge transport layer 33 is referred to as a photosensitive layer.

Suitable materials for use as the electroconductive substrate 31 include materials having a volume resistance not greater than $10^{10}$ Ω·cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, as the substrate 31, a tube can also be used which is prepared by tubing a plate of a metal such as aluminum, aluminum alloys, nickel, stainless steel and the like or tubing by a method such as impact ironing or direct ironing, and then treating the surface of the tube by cutting, super finishing, polishing and the like. Further, endless belts of a metal such as nickel, stainless steel and the like, which have been disclosed, for example, in Japanese Laid-Open Patent Publication No. 52-36016, can also be used as the substrate 31.

Furthermore, substrates, in which a coating liquid including a binder resin and an electroconductive powder is coated on the supporters mentioned above, can be used as the substrate 31. Specific examples of the electroconductive powder include carbon black, acetylene black, powders of metals such as aluminum, nickel, iron, nichrome, copper, zinc, silver and the like, and metal oxides such as electroconductive tin oxides, ITO and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like.

The electroconductive layer can be formed by coating a coating liquid in which an electroconductive powder and a binder resin are dispersed or dissolved in a proper solvent such as tetrahydrofuran, dichloromethane, methyl ethyl ketone, toluene and the like, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins, with an electroconductive material, are also used as the substrate 31.

Next, the photosensitive layer of the photoreceptor of the present invention will be explained.

The charge generation layer 32 is mainly constituted of a charge generation material. As the charge generation material, a TiOPc crystal having an X-ray diffraction spectrum such that a maximum diffraction peak is observed at a Bragg (2θ) angle of 27.2°±0.2° when a specific X-ray of Cu-Kα(wavelength of 1.542 Å) irradiates the TiOPc is preferably used.

The charge generation layer 32 is typically prepared by the following method.

The TiOPc is dispersed in a proper solvent, if desired together with a binder resin, using a dispersing device such as ball mills, attritors, sand mills, super sonic dispersing machines, etc., to prepare a coating liquid. The thus prepared coating liquid is coated on the substrate 31 and dried, resulting in formation of the charge generation layer 32.

Suitable binder resins, which are optionally mixed in the charge generation layer coating liquid, include polyamides, polyurethanes, epoxy resins, polyketones, polycarbonates, silicone resins, acrylic resins, polyvinyl butyral, polyvinyl formal, polyvinyl ketones, polystyrene, polysulfone, poly-N-vinylcarbazole, polyacrylamide, polyvinyl benzal, polyesters, phenoxy resins, vinyl chloride-vinyl acetate copolymers, polyvinyl acetate, polyphenylene oxide, polyamides, polyvinyl pyridine, cellulose resins, casein, polyvinyl alcohol, polyvinyl pyrrolidone, and the like resins.

Among these resins, polyvinyl acetal resins such as polyvinyl butyral resins are preferably used. The content of the binder resin in the charge generation layer 32 is preferably from 0 to 500 parts by weight, and more preferably from 10 to 300 parts by weight, per 100 parts by weight of the charge generation material included therein.

The charge generation layer 32 may include one or more charge generation materials other than the TiOPc crystal mentioned above. Specific examples of such charge generation materials include monoazo pigments, disazo pigments, trisazo pigments, perylene pigments, perynone pigments, quinacridone pigments, quinone type condensed polycyclic compounds, squaric acid type dyes, phthalocyanine pigments other than the TiOPc of the present invention, naphthalocyanine pigments, azulenium salt type dyes, and the like pigments and dyes.

Suitable solvents for use in the charge generation layer coating liquid include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, and the like solvents. In particular, ketone type solvents, ester type solvents and ether type solvents are preferably used.

The charge generation layer coating liquid can be coated by a coating method such as dip coating, spray coating, bead coating, nozzle coating, spinner coating and ring coating methods. The thickness of the charge generation layer 32 is preferably from 0.01 to 5 $\mu$m, and more preferably from 0.1 to 2 $\mu$m.

Then the charge transport layer 33 will be explained in detail.

In the present invention, the charge transport layer 33 is formed by coating on the charge generation layer 32 a coating liquid in which at least a charge transport material and a binder resin are dissolved or dispersed in a solvent including THF, and then drying the coated liquid. In addition, additives such as plasticizers, leveling agents, antioxidants and the like can be added in the coating liquid, if desired.

The charge transport materials are classified into positive-hole transport materials and electron transport materials.

Specific examples of the electron transport materials include electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetanitroxanthone, 2,4,8-trinitrothioxanthone, 2,6,8-trinitro-4H-indeno[1,2-b]thiophene-4-one, 1,3,7-trinitrodibenzothiphene-5,5-dioxide, benzoquinone derivatives and the like.

Specific examples of the positive-hole transport materials include known materials such as poly-N-carbazole and its derivatives, poly-$\gamma$-carbazolylethylglutamate and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, $\alpha$-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, and the like.

These charge transport materials can be used alone or in combination.

Specific examples of the binder resin for use in the charge transport layer include thermoplastic and thermosetting resins such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like.

According to the present invention, it is needed that the weight ratio, water/THF, is kept so as to fall in the range of from 1/50 to 1/0.5. When THF is included too much in the charge transport layer, the THF absorbs the moisture in the TiOPc in the charge transport layer, resulting in change of the crystal form of the TiOPc, and thereby the photosensitivity of the photoreceptor deteriorates. In this case, the change of the crystal form is such that the change is hardly found by the X-ray diffraction spectrum. However, the change of the photoreceptor in photosensitivity is relatively large.

In the present invention, the weight ratio, water/THF, is kept so as to fall in the range of from 1/50 to 1/0.5, preferably from 1/20 to 1/0.8 and more preferably from 1/10 to 1/1, to avoid such a problem that the photosensitivity deteriorates, i.e., to prepare a photoreceptor having high sensitivity.

In order to include moisture in the charge transport layer, for example, the following methods can be used:

(1) deionized water is added to the charge transport layer coating liquid; and (2) when the charge transport layer coating liquid coated on the charge generation layer is dried, moisture or steam is included in the drying air while the drying time and temperature are controlled.

The method (1) is more preferable than the method (2).

When the weight ratio is too small, a photoreceptor having high photosensitivity cannot be prepared. To the contrary, when the ratio is too large, the potential in a lighted area of the resultant photoreceptor increases when the photoreceptor is repeatedly used. Therefore, it is important to include water and THF in the charge transport layer such that the weight ratio falls in the above-mentioned range, to prepare a photoreceptor having high sensitivity and good charge stability.

The binder resin in the charge transport layer preferably has a water absorption not greater than 0.30% to maintain the weight ratio (water/THF) in the above-mentioned range.

Among these resins, polycarbonate resins are preferable because of having good abrasion resistance, good charge properties, and lower water absorption than the other resins listed above. Therefore, polycarbonate resins are preferable to maintain the crystal form of the TiOPc included in the charge transport layer. In particular, bisphenol-Z-form polycarbonate resins having the following repeating unit are preferable.

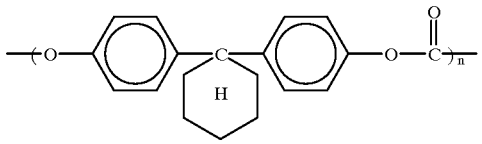

The content of the charge transport material in the charge transport layer is preferably from 20 to 300 parts by weight, and more preferaby from 40 to 150 parts by weight, per 100 parts by weight of the binder resin included in the charge transport layer.

The thickness of the charge transport layer is preferably from 5 to 100 $\mu$m, and more preferably from 15 to 40 $\mu$m.

The charge transport layer is formed by coating a charge transport layer coating liquid on the charge generation layer, and then drying the coated liquid. The charge transport layer coating liquid includes at least THF as a solvent. In order to improve coating property, etc., other solvents which are compatible with THF, such as isopropanol, acetone, methyl ethyl ketone, cyclohexanone, dioxane, ethyl cellosolve, ethyl acetate, methyl acetate, cyclohexane, toluene, xylene, water and the like solvents, can be appropriately added in the charge transport layer coating liquid.

The content of THF in the thus prepared charge transport layer is preferably from 0.01 to 0.5% by weight of the total weight of the solids included in the charge transport layer in order that the resultant photoreceptor has good charge properties such as low residual potential and high photosensitivity. When the content of THF is too low, the resultant film of the charge transport layer tends to have cracks.

As the method for measuring the content of water in a charge transport layer, methods using microwave and the Karl Fischer's method can be used. In the present invention, the Karl Fischer's method is used.

The charge transport layer coating liquid is preferably dried at a temperature of from 110 to 140° C. and for 10 to 40 minutes.

When water is added to the charge transport layer coating liquid, the content of water is preferably from 0.1 to 4.0% by weight of the charge transport layer coating liquid. When the content of water in the charge transport layer coating liquid is too low, it is hard to control the water content of the resultant charge transport layer so as to fall in the preferable range. To the contrary, when the water content in the charge transport layer coating liquid is too high, the coating properties of the coating liquids and the film forming properties of the resultant charge transport layer deteriorate. In particular, when the water content in the charge transport layer coating liquid is too high, a problem which occurs is that the polycarbonate therein tends to be hydrolyzed.

The charge transport layer 33 may include additives such as plasticizers and leveling agents. Specific examples of the plasticizers include known plasticizers, which are used for plasticizing resins, such as dibutyl phthalate, dioctyl phthalate and the like. The addition amount of the plasticizer is 0 to 30% by weight of the binder resin included in the charge transport layer.

Specific examples of the leveling agents include silicone oils such as dimethyl silicone oil, and methyl phenyl silicone oil; polymers or oligomers including a perfluoroalkyl group in their side chain; and the like. The addition amount of the leveling agents is 0 to 1% by weight of the binder resin included in the charge transport layer.

The photoreceptor of the present invention may have an undercoat layer between the substrate 31 and the photosensitive layer (i.e., the charge generation layer 32 in FIG. 1).

The undercoat layer includes a resin as a main component. Since the photoconductive layer is typically formed on the undercoat layer by coating a liquid including an organic solvent, the resin in the undercoat layer preferably has good resistance to the organic solvent. Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, phenolic resins, alkyd-melamine resins, epoxy resins and the like.

The undercoat layer may include a fine powder of metal oxides such as titanium oxide, silica, alumina, zirconium oxide, tin oxide and indium oxide to prevent the occurrence of moiré in the recorded images and to decrease the residual surface potential of the photoreceptor. The undercoat layer can also be formed by coating a coating liquid using a proper solvent and a proper coating method as mentioned above in the photosensitive layer.

A metal oxide layer which is formed, for example, by a sol-gel method using a silane coupling agent, titanium coupling agent or a chromium coupling agent can also be used as an undercoat layer.

A layer of aluminum oxide which is formed by an anodic oxidation method and a layer of an organic compound such as polyparaxylylene or an inorganic compound such as SiO, $SnO_2$, $TiO_2$, ITO or $CeO_2$ which is formed by a vacuum evaporation method are also preferably used as an undercoat layer. The thickness of the undercoat layer is preferably 0 to about 5 $\mu$m.

In the photoreceptor of the present invention, the charge transport layer may be the surface layer of the photoreceptor of the present invention or a protective layer may be formed on the charge transport layer.

Suitable materials for use in the protective layer include ABS resins, ACS resins, olefin-vinyl monomer copolymers, chlorinated polyethers, aryl resins, phenolic resins, polyacetal, polyamides, polyamideimide, polyacrylates, polyarylsulfone, polybutylene, polybutylene terephthalate, polycarbonate, polyethersulfone, polyethylene, polyethylene terephthalate, polyimides, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, epoxy resins and the like. The protective layer may include a particulate fluorine-containing resin (e.g., tetrafluoroethylene) or silicone resin to improve abrasion resistance of the photoreceptor. The protective layer may include an inorganic filler such as titanium oxide, tin oxide, potassium titanate and the like, which is dispersed in a resin such as fluorine-containing resins and silicone resins.

The protective layer can be formed by one of the known coating methods mentioned above for use in the photosensitive layer. The thickness of the protective layer is preferably from 0.1 to 10 $\mu$m. In addition, a layer of amorphous carbon or amorphous silicon carbide, which is formed by a vacuum evaporation method, can also be used as the protective layer.

In the present invention, an intermediate layer may be formed between the photosensitive layer and the protective layer. The intermediate layer includes a resin as a main component. Specific examples of the resin include polyamides, alcohol soluble nylons, polyvinyl butyral having a hydroxide group, polyvinyl butyral, polyvinyl alcohol, and the like. The intermediate layer can be formed by one of the above-mentioned known coating methods. The thickness of the intermediate layer is preferably from 0.05 to 2 $\mu$m.

Next, the image forming method and apparatus of the present invention will be explained in detail referring to drawings.

Figure 2:
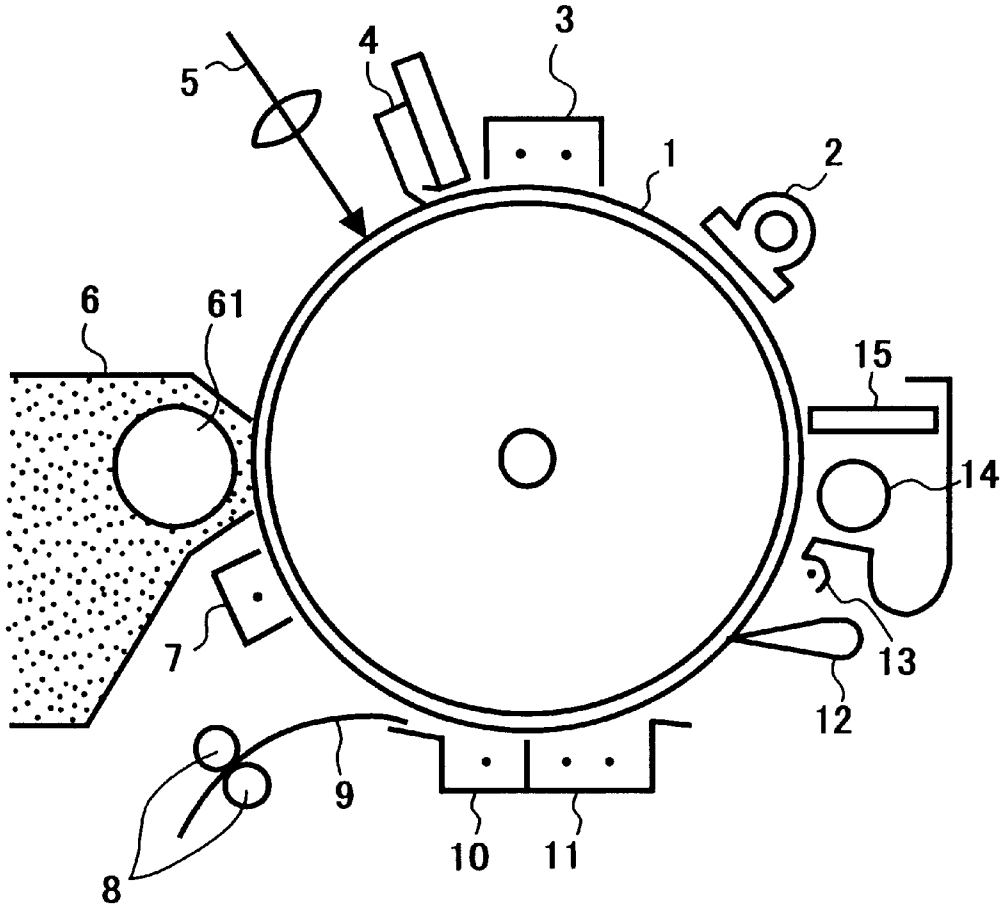
FIG. 2 is a schematic diagram illustrating the main part of an embodiment of the electrophotographic image forming apparatus of the present invention.

FIG. 2 is a schematic view illustrating the main part of an embodiment of the image forming apparatus of the present invention.

In FIG. 2, numeral 1 denotes a cylindrical photoreceptor. The photoreceptor 1 is the photoreceptor of the present invention mentioned above. The photoreceptor 1 may have a sheet shape or an endless belt shape. Around the photoreceptor 1, a discharging lamp 2, a charger 3, an eraser 4, an imagewise light irradiator 5, an image developer 6, a pre-transfer charger 7, a transfer charger 10, a separating charger 11, a separating pick 12, a pre-cleaning charger 13, a cleaning brush 14, and a cleaning blade 15 are provided in this order in the counterclockwise direction. In addition, a pair of registration rollers 8 are provided to feed a receiving material 9 to the space between the photoreceptor 1 and the transfer charger 10 (and the separating charger 11). The photoreceptor 1 rotates in the counterclockwise direction.

Suitable charging devices for use as the charger 3, pre-transfer charger 7, transfer charger 10, separating charger 11, and pre-cleaning charger 13 include known charging devices such as corotrons, scorotrons, solid state chargers, charging rollers and the like devices.

Any known charging devices can be used as the transfer charger 10; however, the transfer device as shown in FIG. 2 (i.e., a combination of the transfer charger 10 with the separating charger 11) is preferable.

Suitable light sources for use in the imagewise light irradiating device 5 and the discharging lamp 2 include fluorescent lamps, tungsten lamps, halogen lamps, mercury lamps, sodium lamps, light emitting diodes (LEDs), laser diodes (LDs), light sources using electroluminescence (EL), and the like. In addition, in order to emit light having a desired wave length range, filters such as sharp-cut filters, band pass filters, near-infrared cutting filters, dichroic filters, interference filters, color temperature converting filters and the like can be used. These light sources can also be used for the image transfer process, discharging process, and cleaning process, and a pre-exposure process which is optionally performed, if it is needed to irradiate the photoreceptor 1 with light in the processes.

The surface of the photoreceptor 1 is charged with the charger 3. The photoreceptor 1 is exposed to imagewise light emitted by the imagewise light irradiator 5, resulting in formation of an electrostatic latent image on the photoreceptor 1. The thus prepared electrostatic latent image is then developed with a toner on a developing roller 61 in the image developer 6, resulting in formation of a toner image on the photoreceptor 1. The toner image is then charged with the pre-transfer charger 7 so as to have a charge suitable for transferring. The toner image is then transferred onto the receiving material 9 while the receiving material 9 is charged with the transfer charger 10. The receiving material 9 is then charged with the separating charger 11 so as to easily separate from the photoreceptor 1 by being released from the state in which the receiving material 9 and the photoreceptor 1 are electrostatically adhered to each other. The receiving material 9 is then separated from the photoreceptor 1 with the separating pick 12. After the toner image transferring process, the surface of the photoreceptor 1 is cleaned using the pre-cleaning charger 13, the fur brush 14 and the cleaning blade 15. The residual toner remaining on the photoreceptor 1 can be removed by only a cleaning brush.

The cleaning process may be performed only by a cleaning brush. Suitable cleaning brushes include fur brushes and magnetic fur brushes.

In charging process, the photoreceptor 1 may be charged positively or negatively. When a latent image having a positive (negative) charge is developed with a toner having a negative (positive) charge, a positive image (i.e., the same image as the latent image) can be obtained. In contrast, when a latent image having a positive (negative) charge is developed with a toner having a positive (negative) charge, a negative image (i.e., a reversal image) can be obtained. As the developing method, known developing methods can be used. In addition, as the discharging methods, known discharging methods can also be used.

Figure 3:
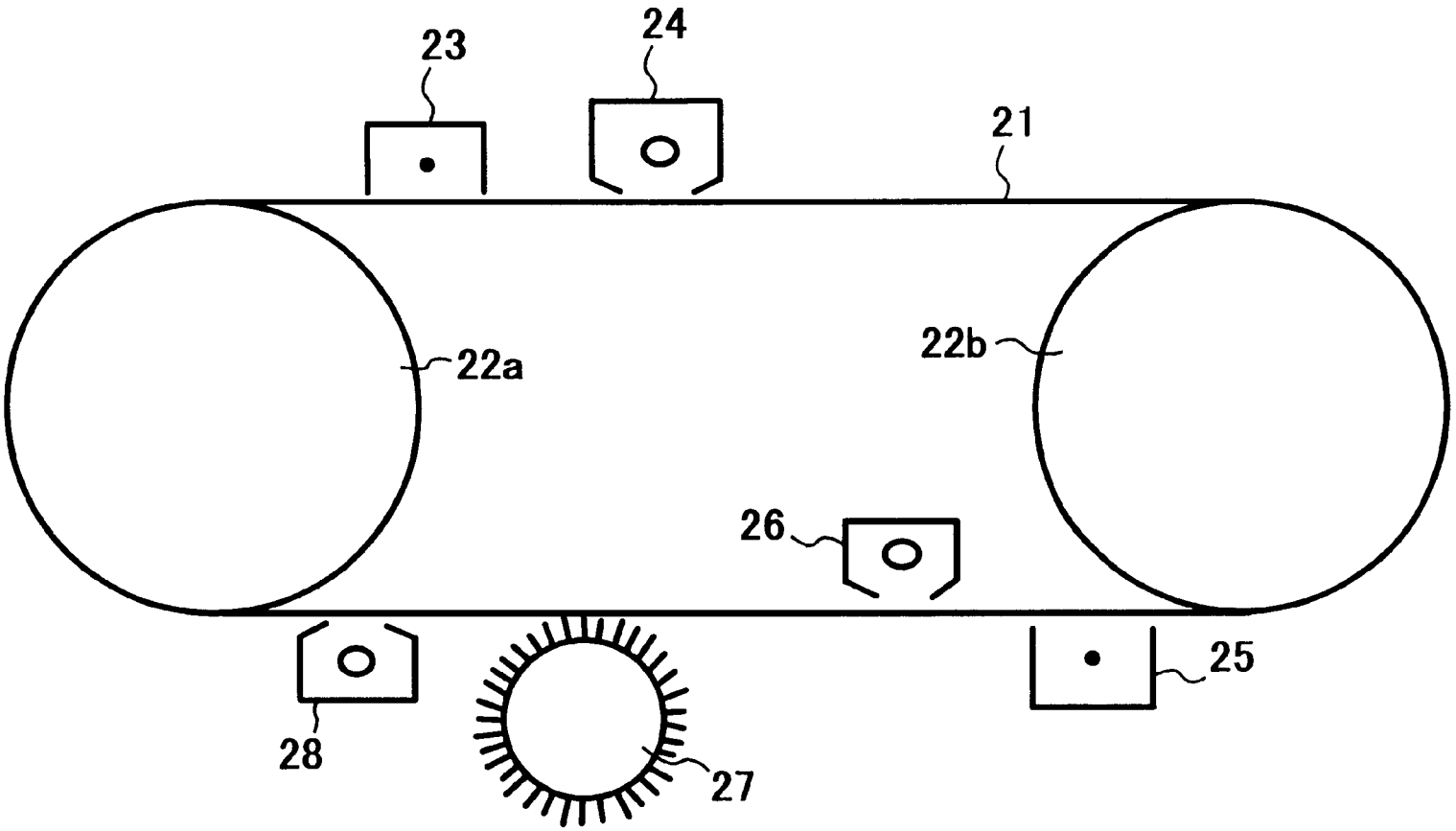
FIG. 3 is a schematic diagram illustrating the main part of another embodiment of the electrophotographic image forming apparatus of the present invention.

FIG. 3 is a schematic view illustrating a main part of another embodiment of the image forming apparatus of the present invention.

In this embodiment, a belt-shaped photoreceptor 21 is used. The photoreceptor 21 is the photoreceptor of the present invention. The belt-shaped photoreceptor 21 is rotated by rollers 22*a* and 22*b*. The photoreceptor 21 is charged with a charger 23, and then exposed to imagewise light emitted by an imagewise light irradiator 24 to form an electrostatic latent image in the photoreceptor 21. The latent image is developed with a developing unit (not shown in FIG. 3) to form a toner image on the photoreceptor 21. The toner image is transferred onto a receiving material (not shown) using a transfer charger 25. After the toner image transferring process, the surface of the photoreceptor 21 is cleaned with a cleaning brush 27 after performing a pre-cleaning light irradiating operation using a pre-cleaning light irradiator 26. Then the photoreceptor 21 is discharged by being exposed to light emitted by a discharging light source 28. In the pre-cleaning light irradiating process, light may irradiate the photoreceptor 21 from the side of the substrate of the photoreceptor 21. In this case, the substrate has to be light-transmissive.

The image forming apparatus of the present invention is not limited to the image forming units as shown in FIGS. 2 and 3. For example, in FIG. 3, the pre-cleaning light irradiating operation can be performed from the photosensitive layer side of the photoreceptor 21. In addition, the light irradiation in the imagewise light irradiating process and the discharging process may be performed from the substrate side of the photoreceptor 21.

Further, a pre-transfer light irradiation operation, which is performed before the transferring of the toner image, and a preliminary light irradiation operation which is performed before the imagewise light irradiation, and other light irradiation operations may also be performed.

The above-mentioned image forming units as shown in FIGS. 2 and 3 can be fixedly incorporated in image forming apparatuses such as copying machines, facsimile machines, printers and the like. Alternatively, the image forming units can be set in image forming apparatuses as a process cartridge.

The process cartridge is, for example, a cartridge which includes a charger, a light irradiating device, a developing device, a transfer device, a cleaning device, and/or a discharging device as well as a photoreceptor.

Figure 4:
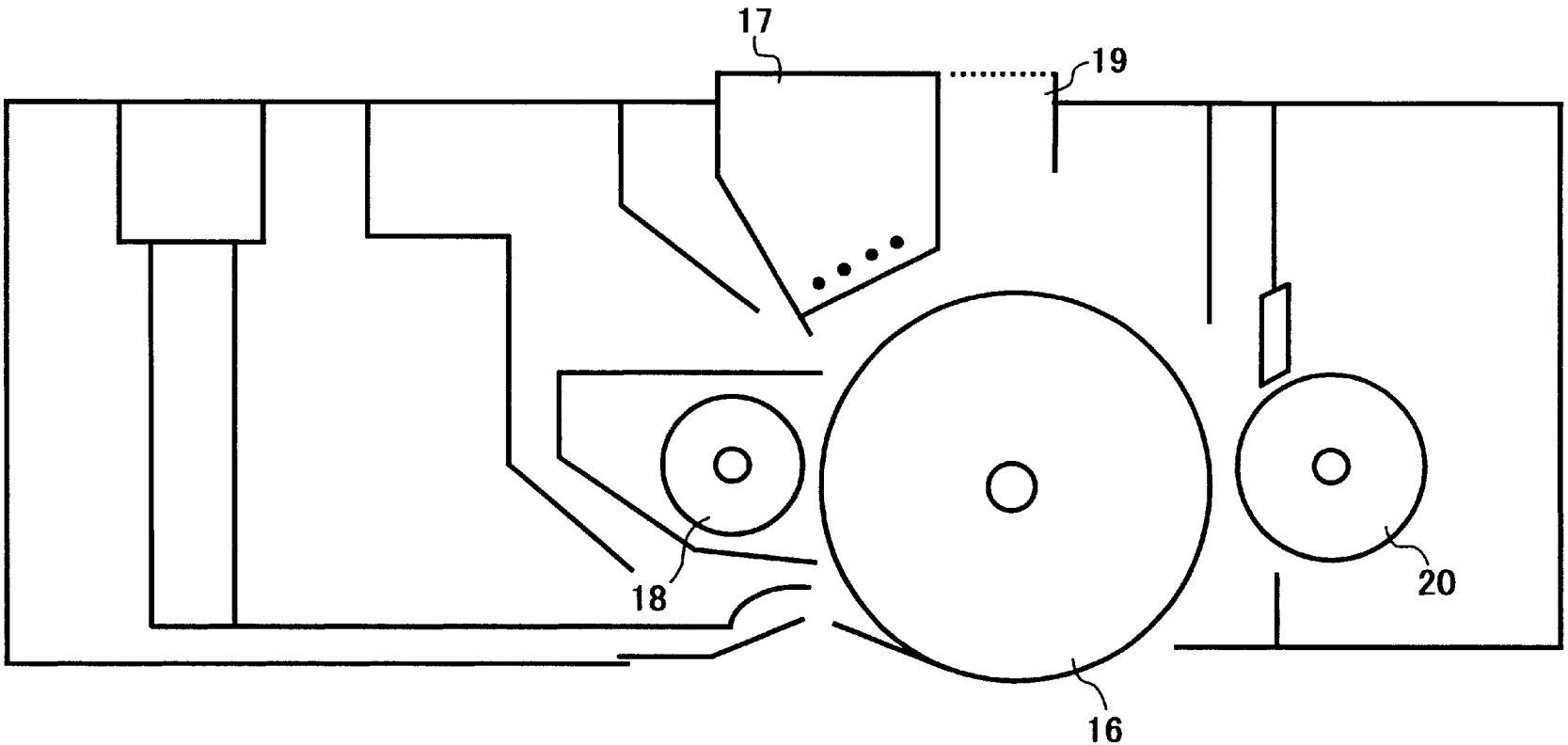
FIG. 4 is a schematic diagram illustrating an embodiment of the process cartridge of the present invention.

FIG. 4 illustrates an embodiment of the process cartridge of the present invention.

As shown in FIG. 4, a photoreceptor 16, a charger 17, a developing roller 19 and a cleaning brush 20 are provided in a housing. The photoreceptor 16 is charged with the charger 17 and exposed to light emitted by an imagewise light irradiator to form an electrostatic latent image. The latent image is developed with a toner on the developing roller 19 to form a toner image. The toner image is transferred on a receiving material (not shown). The surface of the photoreceptor is cleaned by the cleaning brush 20.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis of Titanyl Phthalocyanine

At first, the method for synthesizing a titanyl phthalocyanine crystal for use in the present invention will be explained.

Synthesis Example of Titanyl Phthalocyanine

In a container, 52.5 parts of phthalodinitrile and 400 parts of 1-chloronaphthalene were mixed while agitating. Under a nitrogen current, 19 parts of titanium tetrachloride were dropped therein. After the addition of titanium tetrachloride was completed, the temperature of the mixture was gradually increased to 200° C. The temperature of the mixture was maintained at a temperature ranging from 190 to 210° C. for 5 hours while agitating the mixture to react the compounds. After the reaction was terminated, the reaction product was cooled to 130° C. and filtered to obtain the precipitate. Then the precipitate was washed with chloroform until the precipitate colored blue. The cake was then washed with methanol several times, and further washed with hot water of 80° C. several times. Then the cake was dried. Thus, 42.2 parts of a rough titanyl phthalocyanine powder were obtained. Six (6) parts of the thus prepared rough titanyl phthalocyanine powder were dissolved in 100 parts of 96% sulfuric acid at a temperature ranging from 3 to 5° C. The solution was dropped into 3500 parts of iced water while agitating, to deposit a pigment. The mixture was filtered to obtain the pigment. The pigment was washed with water until the filtrate became neutral (i.e., pH of 7.0). Thus, a wet cake of a titanyl phthalocyanine pigment was prepared.

Then 1500 parts of 1,2-dichloroethane were added to the wet cake of the titanyl phthalocyanine pigment, and the mixture was agitated at room temperature for 2 hours. Then 250 parts of methanol were added therein while agitating. The mixture was filtered. The filtered cake was washed with methanol and then dried. Thus 4.9 parts of a titanyl phthalocyanine pigment were prepared.

X-ray irradiated the titanyl phthalocyanine pigment to obtain its X-ray diffraction spectrum. The conditions were as follows:

X-ray tube: copper

Voltage: 40 kV

Current: 20 mA

Scanning speed: 1°/min

Scanning range: 3° to 40°

Time constant: 2 seconds

Figure 5:
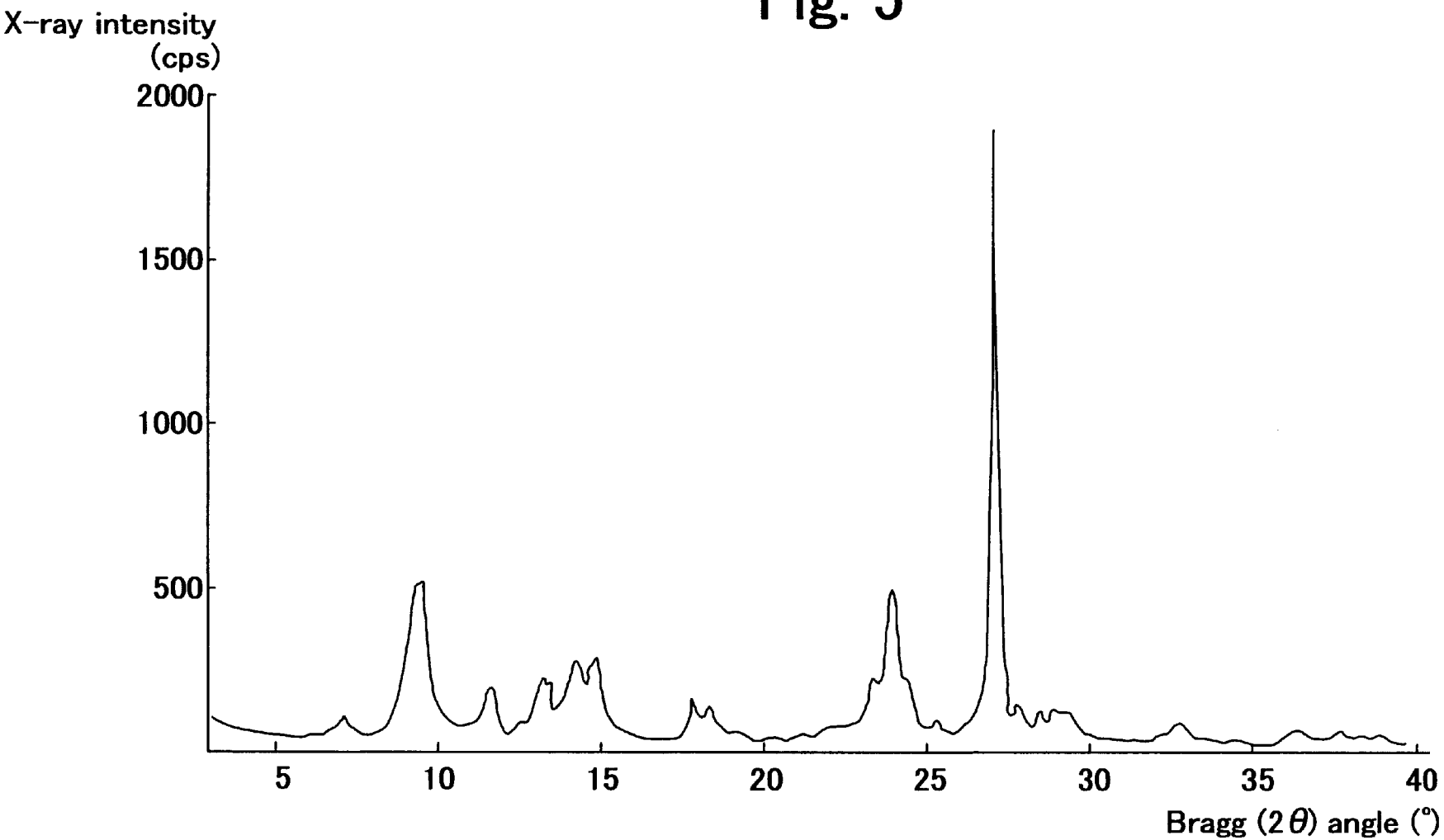
FIG. 5 is a graph illustrating the X-ray diffraction spectrum of the titanyl phthalocyanine crystal synthesized in Synthesis Example in the present application.

The X-ray diffraction spectrum of the TiOPc is shown in FIG. 5. As can be understood from FIG. 5, the maximum peak is observed at a Bragg (2θ) angle of 27.2°±0.2°.

At this point, the variation (±0.2°) of the angle is caused by the synthesis and measurements variations.

Example 1

At first, the following undercoat layer coating liquid was coated on an aluminum cylinder and then dried at 130° C. for 20 minutes to form an undercoat layer having a thickness of 4.0 μm.

Formulation of Undercoat Layer Coating Liquid

| | |
|---|---|
| Titanium oxide | 15 |
| Alkyd resin | 4 |
| Melamine resin | 3 |
| 2-butanone | 150 |

The following charge generation layer coating liquid was coated on the undercoat layer and then dried at 65° C. for 20 minutes. Thus, a charge generation layer having a thickness of 0.2 μm was formed.

Formulation of Charge Generation Layer Coating Liquid

| | |
|---|---|
| TiOPc prepared above | 3 |
| Polyvinyl butyral | 2 |
| 2-butanone | 140 |

The following charge transport layer coating liquid was coated on the charge generation layer and then dried at 130° C. for 20 minutes to form a charge transport layer having a thickness of 24 μm.

Formulation of Charge Transport Layer Coating Liquid

| | |
|---|---|
| Bisphenol-Z-form polycarbonate resin | 10 |
| Charge transport material having the following formula | 8 |

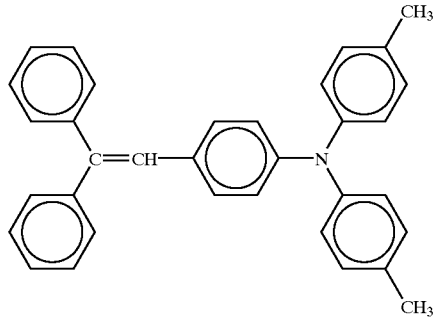

| | |
|---|---|
| Tetrahydrofuran | 75 |
| Deionized water | 0.5 |

Thus, a photoreceptor of Example 1 was prepared.

Example 2

The procedure for preparation of the photoreceptor in Example 1 was repeated except that the addition quantity of deionized water was changed to 1.0 part.

Thus, a photoreceptor of Example 2 was prepared.

Example 3

The procedure for preparation of the photoreceptor in Example 1 was repeated except that the addition quantity of deionized water was changed to 4.0 parts.

Thus, a photoreceptor of Example 3 was prepared.

Example 4

The procedure for preparation of the photoreceptor in Example 1 was repeated except that the drying temperature in the charge transport layer coating process was changed to 125° C.

Thus, a photoreceptor of Example 4 was prepared.

Example 5

The procedure for preparation of the photoreceptor in Example 1 was repeated except that the drying temperature in the charge transport layer coating process was changed to 120° C.

Thus, a photoreceptor of Example 5 was prepared.

Example 6

The procedure for preparation of the photoreceptor in Example 1 was repeated except that the drying temperature in the charge transport layer coating process was changed to 115° C.

Thus, a photoreceptor of Example 6 was prepared.

Comparative Example 1

The procedure for preparation of the photoreceptor in Example 1 was repeated except that the addition quantity of deionized water was changed to 6.0 parts.

Thus, a photoreceptor of Comparative Example 1 was prepared.

Comparative Example 2

The procedure for preparation of the photoreceptor in Example 1 was repeated except that the formulation of the charge transport layer coating liquid was changed as follows, and the drying temperature in the charge transport layer coating process was changed to 100° C.

Formulation of Charge Transport Layer Coating Liquid

| | |
|---|---|
| Bisphenol-Z-form polycarbonate resin | 10 |
| Charge transport material having the following formula | 8 |
| Tetrahydrofuran | 80 |

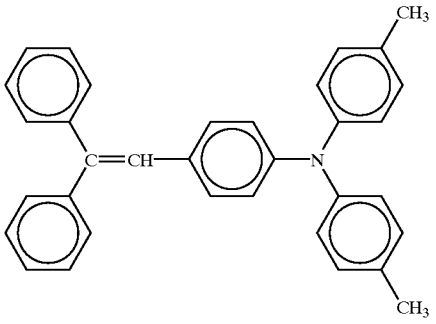

Comparative Example 3

The procedure for preparation of the photoreceptor in Example 1 was repeated except that the addition quantity of deionized water was changed to 8.0 parts.

As a result, the binder resin in the charge transport layer coating liquid was separated out from the liquid, and therefore the coating liquid could not be coated.

Evaluation Method (1) Water/THF Ratio

The charge transport layer of each of the photoreceptors of Examples 1 to 6 and Comparative Examples 1 and 2 was released therefrom. The concentration of THF remaining in the charge transport layer was determined using a pyrolytic gas chromatograph mass spectrometer (GC17A manufactured by Shimazu Corp.) and a Curie point pyrolyzer (JHP-35 manufactured by Japan Analytical Industry Co., Ltd.) which serves as a heater.

The conditions of the instruments are as follows:

GC-17A

Column: DB-WAX

Temperature of column: 50° C. (retained for 5 minutes) to 230° C.

Temperature rising speed: 10° C./min

Injection temperature: 250° C.

Carrier gas: He

Pressure of carrier gas: 150 kPa

In addition, the content of water in the charge transport layer was determined by a Karl Fisher micro-water measuring instrument (CA-05 manufactured by Mitsubishi Chemical Corp.) The conditions of the instrument are as follows:

CA-05

Carrier gas: Nitrogen gas

Flow rate of carrier gas: 200 ml/min

Drying temperature: 140° C.

Thus, the water/THF ratio in the charge transport layer was determined.

(2) Charge Properties

Each photoreceptor was set in an image forming apparatus which has a structure as shown in FIG. 2 in which a laser diode emitting light having a wavelength of 780 nm serves as a light source of the imagewise light irradiator. A probe was set in the apparatus to measure the surface potentials of dark areas and lighted areas of the photoreceptor before the developing process. Twenty two thousand (22000) images were continuously produced. The surface potentials were measured at the beginning and end of the running test.

The results are shown in Table 1.

TABLE 1

| | Addition quantity of water | Water conc. (%) | THF Conc. (%) | Water/THF Ratio | Drying temp. (° C.) | Surface potential (at the beginning) (V) | | Surface Potential (at the end) (V) | |
|---|---|---|---|---|---|---|---|---|---|
| | | | | | | Dark area | Lighted area | Dark area | Lighted area |
| Ex. 1 | 0.5 | 0.087 | 0.101 | 1/1.16 | 130 | 970 | 140 | 950 | 155 |
| Ex. 2 | 1.0 | 0.090 | 0.101 | 1/1.12 | 130 | 950 | 135 | 940 | 150 |
| Ex. 3 | 4.0 | 0.140 | 0.102 | 1/0.73 | 130 | 970 | 135 | 960 | 150 |
| Ex. 4 | 0.5 | 0.084 | 0.322 | 1/9.28 | 125 | 940 | 145 | 920 | 155 |
| Ex. 5 | 0.5 | 0.076 | 1.068 | 1/14.1 | 120 | 940 | 145 | 910 | 150 |
| Ex. 6 | 0.5 | 0.067 | 2.876 | 1/42.9 | 115 | 900 | 150 | 890 | 160 |
| Comp. Ex. 1 | 6.0 | 0.190 | 0.094 | 1/0.49 | 130 | 940 | 200 | 920 | 350 |
| Comp. Ex. 2 | 0 | 0.069 | 3.481 | 1/50.4 | 100 | 780 | 165 | 620 | 230 |

As can be understood from Table 1, when the water/THF ratio ranges from 1/50 to 1/0.5, the photoreceptor can stably maintain good charging properties even when repeatedly used.

Example 7

The following undercoat layer coating liquid was coated on an electroformed nickel belt and then dried at 130° C. for 20 minutes. Thus an undercoat layer having a thickness of 0.3 μm was formed on the nickel belt.

Formulation of Undercoat Layer Coating Liquid

| | |
|---|---|
| Titanium oxide | 7 |
| Alcohol-soluble nylon resin | 4 |
| Methanol | 45 |
| Butanol | 25 |

The following charge generation layer coating liquid was coated on the undercoat layer and then dried at 75° C. for 20 minutes. Thus charge generation layer having a thickness of 0.4 μm was prepared.

Formulation of Charge Generation Layer Coating Liquids

| | |
|---|---|
| TiOPc prepared above | 3 |
| Polyvinyl butyral | 2 |
| 2-butanone | 100 |
| Cyclohexanone | 20 |

The following charge transport layer coating liquid was coated on the charge generation layer and then dried at 135° C. for 20 minutes. Thus a charge transport layer having a thickness of 28 μm was prepared.

Formulation of Charge Transport Layer Coating Liquid

| | |
|---|---|
| Polyacrylate | 10 |
| Charge transport material having the following formula | 9 |

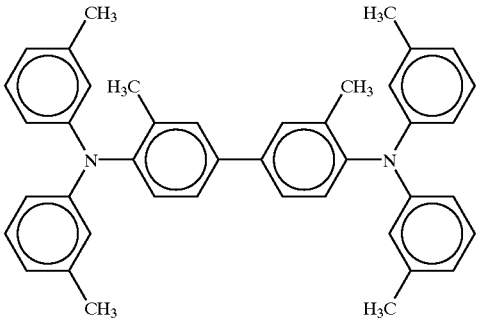

| | |
|---|---|
| Tetrahydrofuran | 80 |
| Deionized water | 0.5 |

Thus a photoreceptor of Example 7 was prepared.

Example 8

The procedure for preparation of the photoreceptor in Example 7 was repeated except that the binder resin in the charge transport layer coating liquid was changed from the polyarylate resin to a bisphenol-Z-form polycarbonate resin.

Thus, a photoreceptor of Example 8 was prepared.

Example 9

The procedure for preparation of the photoreceptor in Example 8 was repeated except that the addition quantity of deionized water in the charge transport layer coating liquid was changed to 1.0 part.

Thus, a photoreceptor of Example 9 was prepared.

Example 10

The procedure for preparation of the photoreceptor in Example 8 was repeated except that the addition quantity of deionized water in the charge transport layer coating liquid was changed to 4.0 parts.

Thus, a photoreceptor of Example 10 was prepared.

Comparative Example 4

The procedure for preparation of the photoreceptor in Example 8 was repeated except that the addition quantity of deionized water in the charge transport layer coating liquid was changed to 6.0 parts.

Thus a photoreceptor of Comparative Example 4 was prepared.

Evaluation Method (1) Image Qualities

Each photoreceptor was set in an image forming apparatus which has a structure as shown in FIG. 3 in which a laser diode emitting light having a wavelength of 780 nm serves as a light source of the imagewise light irradiator, and a polygon mirror is used for irradiating imagewise light. Fifteen thousand (15000) images were continuously produced. The image qualities of the produced images were evaluated at the beginning and end of the running test.

(2) Abrasion of Photosensitive Layer

The thickness of each photosensitive layer was measured before and after the running test to determine the abrasion of the photosensitive layer.

The results are shown in Table 2.

TABLE 2

| | Addition quantity of water | Water conc. (%) | THF Conc. (%) | Water/THF Ratio | Drying temp (° C.) | Image qualities Beginning | Image qualities End | Water/THF Ratio after running test | Abrasion (μm) |
|---|---|---|---|---|---|---|---|---|---|
| Ex. 7 | 0.5 | 0.118 | 0.117 | 1/0.99 | 135 | good | Slight background soil | 1/0.72 | 6.8 |
| Ex. 8 | 0.5 | 0.086 | 0.114 | 1/1.33 | 135 | good | good | 1/1.02 | 2.5 |
| Ex. 9 | 1.0 | 0.092 | 0.112 | 1/1.21 | 135 | good | good | 1/0.97 | 2.9 |
| Ex.10 | 4.0 | 0.135 | 0.114 | 1/0.84 | 135 | good | good | 1/0.67 | 2.4 |
| Comp. Ex. 4 | 6.0 | 0.198 | 0.097 | 1/0.49 | 135 | Slight background soil | background soil | 1/0.39 | 2.5 |

As can be understood from Table 2, good images can be stably produced by the photoreceptor keeping a water/THF ratio in a range of from 1/50 to 1/0.5.

Example 11

On an aluminum cylinder, which had been subjected to an anodic oxidation treatment and then a sealing treatment, the following charge generation layer coating liquid was coated and then dried at 65° C. for 30 minutes to prepare a charge generation layer of 0.3 μm.

Formulation of Charge Generation Layer Coating Liquid

| | |
|---|---|
| TiOPc prepared above | 3 |
| Polyvinyl butyral resin | 2 |
| Cyclohexanone | 200 |
| 2-butanone | 100 |

The following charge transport layer coating liquid was coated on the charge generation layer and then dried at 130° C. for 20 minutes to prepare a charge generation layer of 22 μm.

Formulation of Charge Transport Layer Coating Liquid

| | |
|---|---|
| Bisphenol-Z-form polycarbonate resin | 10 |
| Charge transport material having the following formula | 7 |

-continued

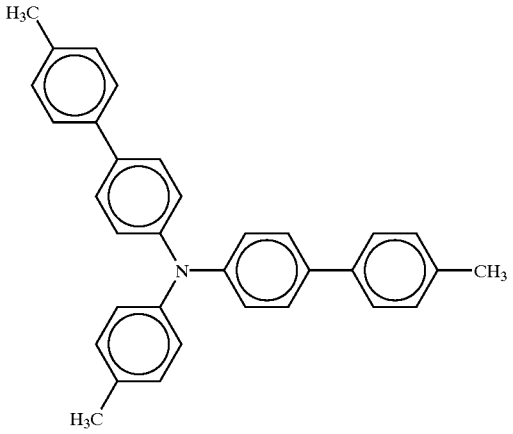

| | |
|---|---|
| Tetrahydrofuran | 80 |
| Deionized water | 0.5 |

Thus a photoreceptor of Example 11 was prepared.

Example 12

The procedure for preparation of the photoreceptor in Example 11 was repeated except that the addition quantity of deionizd water in the charge transport layer coating liquid was changed to 1.0 part.

Thus a photoreceptor of Example 12 was prepared.

Example 13

The procedure for preparation of the photoreceptor in Example 11 was repeated except that the addition quantity of deionizd water in the charge transport layer coating liquid was changed to 4.0 parts.

Thus a photoreceptor of Example 13 was prepared.

Comparative Example 5

The procedure for preparation of the photoreceptor in Example 11 was repeated except that the addition quantity of deionizd water in the charge transport layer coating liquid was changed to 6.0 parts.

Thus a photoreceptor of Comparative Example 5 was prepared.

Evaluation Method (1) Charge Properties

Each photoreceptor was set in a process cartridge which has a structure as shown in FIG. 4. The process cartridge was set in an image forming apparatus in which a laser diode emitting light having a wavelength of 780 nm serves as a light source of the imagewise light irradiator. A probe was set in the apparatus to measure the surface potentials of dark areas and lighted areas of the photoreceptor before the developing process. Nine thousand (9000) images were continuously produced. The surface potentials were measured at the beginning and end of the running test.

The results are shown in Table 3.

TABLE 3

| | Addition quantity of water | Water conc. (%) | THF conc. (%) | Water/THF Ratio | Drying Temp (° C.) | Surface potential (at the beginning) (V) Dark area | Surface potential (at the beginning) (V) Lighted area | Surface potential (at the end) (V) Dark area | Surface potential (at the end) (V) Lighted area |
|---|---|---|---|---|---|---|---|---|---|
| Ex. 11 | 0.5 | 0.081 | 0.097 | 1/1.20 | 130 | 725 | 130 | 705 | 145 |
| Ex. 12 | 1.0 | 0.094 | 0.101 | 1/1.07 | 130 | 700 | 120 | 695 | 135 |
| Ex. 13 | 4.0 | 0.141 | 0.095 | 1/0.67 | 130 | 720 | 125 | 705 | 135 |
| Comp. Ex. 5 | 6.0 | 0.188 | 0.092 | 1/0.49 | 130 | 710 | 190 | 695 | 265 |

As can be understood from Table 3, when the water/THF ratio ranges from 1/50 to 1/0.5, the photoreceptor can maintain good charge properties even when repeatedly used.

Example 14

The following undercoat layer coating liquid was coated on an electroformed nickel belt and then dried at 130° C. for 20 minutes. Thus an undercoat layer having a thickness of 0.5 μm was formed on the nickel belt.

Formulation of Undercoat Layer Coating Liquid

| | |
|---|---|
| Titanium oxide | 5 |
| Alcohol-soluble nylon resin | 4 |
| Methanol | 50 |
| Butanol | 20 |

The following charge generation layer coating liquid was coated on the undercoat layer and then dried at 75° C. for 30 minutes. Thus charge generation layer having a thickness of 0.2 μm was prepared.

Formulation of Charge Generation Layer Coating Liquids

| | |
|---|---|
| TiOPc prepared above | 3 |
| Polyvinyl butyral | 3 |
| Cyclohexanone | 50 |
| 2-butanone | 130 |

The following charge transport layer coating liquid was coated on the charge generation layer and then dried at 135° C. for 20 minutes. Thus a charge transport layer having a thickness of 23 μm was prepared.

Formulation of Charge Transport Layer Coating Liquid

| | |
|---|---|
| Bisphenol-Z-form polycarbonate resin | 10 |
| Charge transport material having the following formula | 9 |

-continued

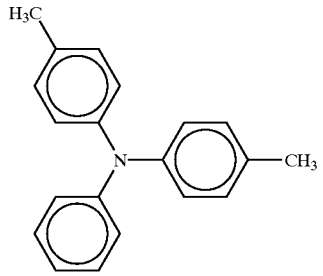

| | |
|---|---|
| Tetrahydrofuran | 80 |
| Deionized water | 0.5 |

Thus a photoreceptor of Example 14 was prepared.

Example 15

The procedure for preparation of the photoreceptor in Example 14 was repeated except that the addition quantity of deionized water was changed to 1.0 part.

Thus, a photoreceptor of Example 15 was prepared.

Example 16

The procedure for preparation of the photoreceptor in Example 14 was repeated except that the addition quantity of deionized water was changed to 4.0 parts.

Thus, a photoreceptor of Example 16 was prepared.

Example 17

The procedure for preparation of the photoreceptor in Example 14 was repeated except that the coating operation of the charge transport layer coating liquid was performed under environmental conditions of 30° C. and 90% RH.

Thus, a photoreceptor of Example 17 was prepared.

Comparative Example 6

The procedure for preparation of the photoreceptor in Example 14 was repeated except that the addition amount of deionized water was changed to 6.0 part and the drying temperature and time in the charge transport layer coating process were changed to 150° C. and 40 minutes, respectively.

Thus, a photoreceptor of Comparative Example 6 was prepared.

Comparative Example 7

The procedure for preparation of the photoreceptor in Example 14 was repeated except that the addition quantity of deionized water was changed to 6.0 parts.

Thus, a photoreceptor of Comparative Example 7 was prepared.

Comparative Example 8

The procedure for preparation of the photoreceptor in Example 14 was repeated except that the formulations of the charge generation layer coating liquid and the charge transport layer coating liquid were changed as follows and the drying temperature in the charge transport layer coating process was changed to 100° C.

Formulation of Charge Generation Layer Coating Liquid

| | |
|---|---|
| TiOPc prepared above | 3 |
| Polyvinyl butyral | 3 |
| Tetrahydrofuran | 150 |
| Deionized water | 20 |

Formulation of Charge Transport Layer Coating Liquid

| | |
|---|---|
| Bisphenol-Z-form polycarbonate resin | 10 |
| Charge transport material having the following formula | 9 |

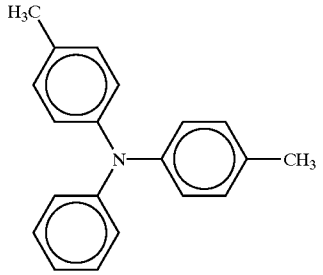

| | |
|---|---|
| Tetrahydrofuran | 80 |

Thus, a photoreceptor of Comparative Example 8 was prepared.

Evaluation Method (1) Image Qualities

Each photoreceptor was set in an image forming apparatus which has a structure as shown in FIG. 3 in which a laser diode emitting light having a wavelength of 780 nm serves as a light source of the imagewise light irradiator, and a polygon mirror is used for irradiating imagewise light. Thirteen thousand (13000) images were continuously produced. The image qualities of the produced images were evaluated at the beginning and end of the running test.

The results are shown in Table 4.

TABLE 4

| | Addition quantity of water | Water conc. (%) | THF Conc. (%) | Water/THF ratio | Drying Temp. (° C.) | Image qualities Beginning | Image qualities End |
|---|---|---|---|---|---|---|---|
| Ex. 14 | 0.5 | 0.084 | 0.111 | 1/1.32 | 135 | good | good |
| Ex. 15 | 1.0 | 0.093 | 0.109 | 1/1.17 | 135 | good | good |
| Ex. 16 | 4.0 | 0.139 | 0.112 | 1/0.81 | 135 | good | good |
| Ex. 17 | 0.5 | 0.127 | 0.104 | 1/0.82 | 135 | good | good |
| Comp. Ex. 6 | 6.0 | 0.197 | 0.008 | 1/0.04 | 150 | Slight background soil | background soil |
| Comp. Ex. 7 | 6.0 | 0.205 | 0.101 | 1/0.49 | 135 | Slight background soil | background soil |
| Comp. EX. 8 | 0 | 0.064 | 3.942 | 1/61.6 | 100 | A number of black spots* | Not evaluated |

*It is considered that the black spots were caused by the dielectric breakdown of the photosensitive layer.

As can be understood from Table 4, when the water/THF ratio ranges from 1/50 to 1/0.5, the photoreceptor can stably produce food images even when repeatedly used.

As described above, by controlling the water/THF ratio in the charge transport layer formed on the charge generation layer including a TiOPc so as to be fall in a range of from 1/50 to 1/0.5, the resultant photoreceptor has a good combination of high photosensitivity and good charge properties. In addition, the photoreceptor has good abrasion resistance. Further, the photoreceptor can maintain the good combination of high photosensitivity and good charge properties even when repeatedly used for a long period of time.

This document claims priority and contains subject matter related to Japanese Patent Application No. 2000-135978, filed on May 9, 2000, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A photoreceptor comprising:

an electroconductive substrate;

a charge generation layer overlying the electroconductive substrate and comprising as a charge generation material a titanyl phthalocyanine crystal having an X-ray diffraction spectrum such that a maximum diffraction peak is observed at a Bragg (2θ) angle of 27.2°±0.2° when a specific X-ray of Cu-Kα having a wavelength of 1.542 Å irradiates the titanyl phthalocyanine crystal; and a charge transport layer on the charge generation layer and comprising a binder resin, a charge transport material, water and tetrahydrofuran, wherein a weight ratio of the water to the tetrahydrofuran in the charge transport layer is from 1/50 to 1/0.5.

2. The photoreceptor according to claim 1, wherein the tetrahydrofuran is present in the charge transport layer in an amount of from 0.01 to 0.5% by weight based on total solid components in the charge transport layer.

3. The photoreceptor according to claim 1, wherein the binder resin in the charge transport layer comprises a bisphenol-Z-form polycarbonate resin.

4. The photoreceptor according to claim 1, wherein the binder resin in the charge transport layer has a water absorption not greater than 0.30%.

5. The photoreceptor according to claim 1, further comprising an undercoat layer between the electroconductive substrate and the charge generation layer.

6. A method for manufacturing a photoreceptor comprising:

forming a charge generation layer overlying an electroconductive substrate, wherein the charge generation layer comprises a titanyl phthalocyanine crystal having an X-ray diffraction spectrum such that a maximum diffraction peak is observed at a Bragg (2θ) angle of 27.2°±0.2° when a specific X-ray of Cu-Kα having a wavelength of 1.542 Å irradiates the titanyl phthalocyanine crystal; and forming a charge transport layer on the charge generation layer by coating the charge generation layer with a charge transport layer coating liquid comprising a charge transport material, a binder resin, tetrahydrofuran and water, wherein a weight ratio of the water to the tetrahydrofuran in the charge transport layer is from 1/50 to 1/0.5.

7. The method according to claim 6, wherein the tetrahydrofuran is present in the charge transport layer coating liquid in an amount of from 0.1 to 4.0% by weight.

8. The method according to claim 6, wherein the binder resin in the charge transport layer comprises a bisphenol-Z-form polycarbonate resin.

9. An image forming method comprising:

charging a photoreceptor;

irradiating the photoreceptor with light to form an electrostatic latent image on the photoreceptor;

developing the electrostatic latent image with a developer comprising a toner to form toner image on the photoreceptor;

transferring the toner image on a receiving material;

cleaning a surface of the photoreceptor; and discharging a remaining charge on the photoreceptor, wherein the photoreceptor comprises:

an electroconductive substrate;

a charge generation layer overlying the electroconductive substrate and comprising as a charge generation material a titanyl phthalocyanine crystal having an X-ray diffraction spectrum such that a maximum diffraction peak is observed at a Bragg (2θ) angle of 27.2°±0.2° when a specific X-ray of Cu-Kα having a wavelength of 1.542 Å irradiates the titanyl phthalocyanine crystal; and a charge transport layer on the charge generation layer and comprising a binder resin, a charge transport material, water and tetrahydrofuran;

wherein a weight ratio of the water to the tetrahydrofuran in the charge transport layer is from 1/50 to 1/0.5.

10. The image forming method according to claim 9, wherein the tetrahydrofuran is present in the charge transport layer in an amount of from 0.01 to 0.5% by weight based on total solid components in the charge transport layer.

11. The image forming method according to claim 9, wherein the binder resin in the charge transport layer comprises a bisphenol-Z-form polycarbonate resin.

12. The image forming method according to claim 9, wherein the binder resin in the charge transport layer has a water absorption not greater than 0.30%.

13. The image forming method according to claim 9, further comprising an undercoat layer between the electroconductive substrate and the charge generation layer.

14. an image forming apparatus comprising:

a photoreceptor;

a charger configured to charge the photoreceptor;

a light irradiator configured to irradiate the photoreceptor with light to form an electrostatic latent image on the photoreceptor;

an image developer configured to develop the electrostatic latent image with a developer comprising a toner to form a toner image on the photoreceptor;

an image transfer configured to transfer the toner image on a receiving material;

a cleaner configured to clean the surface of the photoreceptor; and a discharger configured to discharge a remaining charge on the photoreceptor;

wherein the photoreceptor comprises:

an electroconductive substrate;

a charge generation layer overlying the electroconductive substrate and comprising as a charge generation a titanyl phthalocyanine crystal having an X-ray diffraction spectrum such that a maximum diffraction peak is observed at a Bragg (2θ) angle of 27.2°±0.2° when a specific X-ray of Cu-Kα having a wavelength of 1.542 Å irradiates the titanyl phthalocyanine crystal; and a charge transport layer on the charge generation layer and comprising a binder resin a charge transport material, water and tetrahydrofuran;

wherein a weight ratio of the water to the tetrahydrofuran in the charge transport layer is from 1/50 to 1/0.5.

15. The image forming apparatus according to claim 14, wherein the tetrahydrofuran is present in the charge transport layer in an amount of from 0.01 to 0.5% by weight based on total solid components in the charge transport layer.

16. The image forming apparatus according to claim 14, wherein the binder resin in the charge transport layer comprises a bisphenol-Z-form polycarbonate resin.

17. The image forming apparatus according to claim 14, wherein the binder resin in the charge transport layer has a water absorption not greater than 0.30%.

18. The image forming apparatus according to claim 14, further comprising an undercoat layer between the electroconductive substrate and the charge generation layer.

19. A process cartridge for an electrophotographic image forming apparatus, comprising:

a housing; and a photoreceptor, wherein the photoreceptor comprises:

a charge generation layer overlying the electroconductive substrate and comprising as a charge generation material a titanyl phthalocyanine crystal having an X-ray diffraction spectrum such that a maximum diffraction peak is observed at a Bragg (2θ) angle of 27.2°±0.2° when a specific X-ray of Cu-Kα having a wavelength of 1.542 Å irradiates the titanyl phthalocyanine crystal; and a charge transport layer on the charge generation layer and comprising a binder resin, a charge transport material, water and tetrahydrofuran;

wherein a weight ratio of the water to the tetrahydrofuran in the charge transport layer is from 1/50 to 1/0.5.

20. The process cartridge according to claim 19, wherein the tetrahydrofuran is present in the charge transport layer in an amount of from 0.01 to 0.5% by weight based on total solid components in the charge transport layer.

21. The process cartridge according to claim 19, wherein the binder resin in the charge transport layer comprises a bisphenol-Z-form polycarbonate resin.

22. The process cartridge according to claim 19, wherein the binder resin in the charge transport layer has a water absorption not greater than 0.30%.

23. The process cartridge according to claim 19, further comprising an undercoat layer between the electroconductive substrate and the charge generation layer.

* * * * *